US006688483B2

(12) United States Patent
Davis

(10) Patent No.: US 6,688,483 B2
(45) Date of Patent: Feb. 10, 2004

(54) MOLDED PLASTIC PAIL WITH DOUBLE LOCK

(75) Inventor: Christopher L. Davis, Shelby Township, MI (US)

(73) Assignee: Letica Corporation, Rochester, MI (US)

( * ) Notice: Subject to any disclaimer, the term of this patent is extended or adjusted under 35 U.S.C. 154(b) by 37 days.

(21) Appl. No.: 09/977,745

(22) Filed: Oct. 15, 2001

(65) Prior Publication Data

US 2003/0071043 A1 Apr. 17, 2003

(51) Int. Cl.[7] ..... B65D 17/40
(52) U.S. Cl. ..... 220/276; 220/781
(58) Field of Search ..... 220/276, 781, 220/784, 788, 793, 284, 286, 796, 800, 802; 206/508, 509, 511, 503; 215/254, 256, 305, 354

(56) References Cited

U.S. PATENT DOCUMENTS 3,811,597 A 5/1974 Frankenberg et al.
4,412,630 A * 11/1983 Daenen ..... 220/792
4,735,337 A 4/1988 Von Holdt
4,930,656 A * 6/1990 Blanchette ..... 220/276
5,163,576 A 11/1992 Galer
5,238,135 A * 8/1993 Landis ..... 220/276
5,730,309 A 3/1998 Jiradejnunt et al.
6,056,138 A 5/2000 Chen
6,279,774 B1 * 8/2001 Clute et al. ..... 220/792

FOREIGN PATENT DOCUMENTS

DE 3302146 A1 * 7/1984 ..... 220/276

OTHER PUBLICATIONS

Pub. US 2001/47994 A1, Von Holdt, Jr., Dec. 6, 2001.*

* cited by examiner

*Primary Examiner*—Nathan J. Newhouse
*Assistant Examiner*—Lien Ngo
(74) *Attorney, Agent, or Firm*—Young & Basile P.C.

(57) ABSTRACT

A molded plastic container and closure is provided with a double lock, the top lock being formed by the container rim and a protrusion on the inside of the closure channel. The bottom lock is formed by a segmented flange on the container sidewall and a second annular protrusion on the inside of the closure skirt. A zig-zag tear line allows the second lock to be removed thereby to create alternating areas of greater and lesser clearance between the newly formed skirt edge and a second, lower flange on the container sidewall.

9 Claims, 4 Drawing Sheets

MOLDED PLASTIC PAIL WITH DOUBLE LOCK

FIELD OF THE INVENTION

This invention relates to molded plastic containers and closures and more particularly to a closure having a tear-band which, when torn away, makes the closure easier to remove from the container.

BACKGROUND OF THE INVENTION

It is known to provide plastic shipping containers and closures with secure locking arrangements which require some type of physical alteration to the closure structure before it can be easily removed from the container. For example, some closures are provided with small apertures in the peripheral skirt to permit the skirt to be split or fractured at several circumferentially spaced locations. The loss of integrity in the skirt allows sections of it to be pulled outwardly such that they pass more readily over a locking flange formed on the top of the container when one wishes to remove the closure from the container.

Another example of a closure requiring physical alteration for removal is the tear-band closure. The skirt portion of this type of closure is provided with a circumferential tear line of structural weakness which allows a lower portion of the skirt to be torn away thus to eliminate some or all of a locking arrangement between the container and closure.

Both the fracturable skirt closure and the tear-band closure have the characteristics of providing a strong lock when first applied, providing evidence of tampering, and providing a measure of resealability even after the locking structure has been altered or removed.

SUMMARY OF THE INVENTION

This invention is described with reference to a molded plastic container/closure combination of the type having a tear-band in the closure skirt for removability. The invention provides a strong pre-tear lock and seal, a strong post-tear seal and improved post-tear removability.

In general, the invention is applied to a plastic container having an outwardly formed top rim and first and second ring-like outwardly-extending flanges formed on the container sidewall at first and second locations below the top rim. The closure is of the type having an inverted U-shaped peripheral channel which receives the container rim therein and seals thereto when fully set in place. The outermost interior wall of the closure channel is provided with first and second circumferentially continuous, inwardly extending protrusions, the top-most of which coacts with the container rim to provide a first lock and the lower-most of which coacts with the top ring-like flange on the container outer sidewall to provide a second lock. The lower sidewall flange is closely adjacent the bottom of the closure skirt to make it difficult or impossible to pull outwardly on the skirt.

A tear line; i.e., a line of structural weakness which is more easily torn or fractured than the balance of the closure skirt, is formed in the skirt between the upper and lower protrusions such that physical removal of the tear-band eliminates the second lock thereby facilitating removal of the closure from the container.

In the preferred embodiment disclosed herein, the tear line is irregular or zig-zag in design thereby to create a plurality of circumferentially spaced tabs or grasp areas which extend toward but are spaced from the topmost of the flanges. The topmost flange is preferably made discontinuous or segmented as to provide spaced areas of maximum clearance between the grasp tabs and the bottom-most side flange. The closure and lid are designed so that such areas of maximum clearance are guaranteed to occur no matter what the angular relationship between the closure and the container when the closure is applied.

Also in the preferred embodiment, the inner wall of the closure is made deeper than normal and fits against a step in the inner container wall to stabilize the closure under heavy loading conditions such as occur when filled containers are stacked.

Other arrangements for applying the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
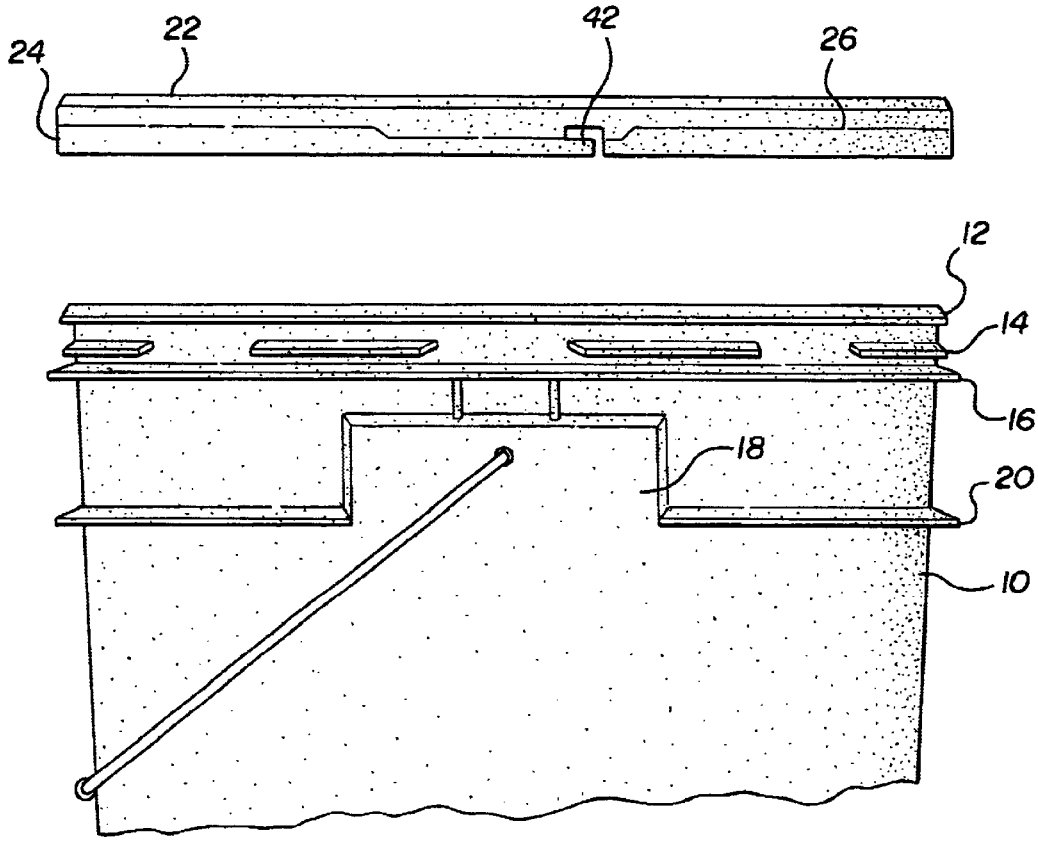
FIG. 1 is a side view of a container and closure combination prior to assembly of same.

Referring to FIG. 1, there is shown an injection molded plastic container 10 of tapered, cylindrical configuration. Container 10 may be manufactured from any of a variety of plastics including high density polyethylene in any or all of a variety of sizes including, by way of example only, four and five gallon sizes. Container 10 has an open top defined by an outwardly and downwardly turned rim 12. High density polyethylene is a suitable material but other plastics may be used.

Spaced below the rim 12 and at first and second vertical distances therefrom along the container sidewall are ring-like circumferential flanges 14 and 16. Flange 14 is segmented and in this embodiment is made up of eight segments with eight gaps 44 or vacancies between them. In a four-gallon container, the flange 14 is about ¾" below the rim 12. Flange 16 is circumferentially continuous, is radially larger than flange 14 and is about ½" below flange 14. Both flanges 14 and 16 are angled downwardly in side profile.

Container 10 is further provided with a pair of diametrically opposite bail-receiving structures 18 and a third circumferential flange 20. A wire bail may be assembled to the structures 18 in a known manner.

Figure 2:
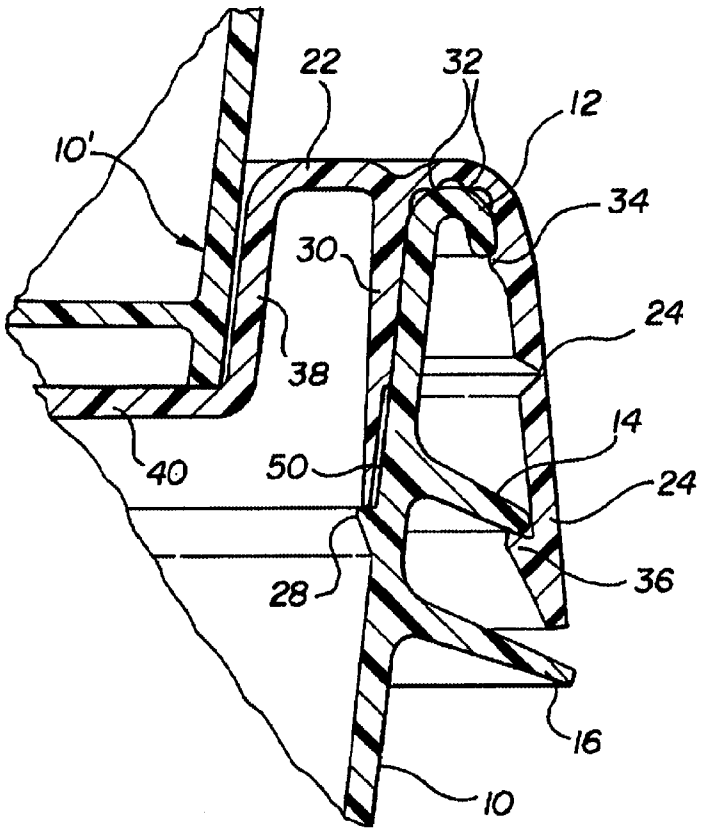
FIG. 2 is a sectional view of a portion of the FIG. 1 structure showing the relationship of the container and closure after assembly of same but before removal of the tear-band.

FIG. 1 further shows a closure 22 which may also be injection molded of high density polyethylene or other suitable plastic material. The closure 22 has an outer skirt 24 which, when the closure is applied as shown in FIG. 2, overlies the rim 12 and a portion of the upper container sidewall. A zig-zag tear line 26 is formed in the skirt 24.

Referring to FIG. 2, this enlarged detail view shows the fact that the flanges 14 and 16 are preferably downwardly angled at about 16° to 20°. FIG. 2 also shows the container rim 12 to have a smooth, rounded top surface. The interior sidewall has a step 28 formed therein about 2" below the rim 12; i.e., opposite the flange 14.

FIG. 2 shows closure 22 to exhibit an inverted, U-shaped channel defined by and between an inner leg 30 and the skirt 24. When applied to the container 10, the inner leg 30 lies against the interior sidewall of the container 10 and rests on the step 28. The top interior surface of the closure channel is provided with flexible seal ridges 32 which sealingly bear against the smooth top surface of rim 12 when the closure is applied to the container 10.

A first annular locking protrusion 34 is formed on the interior surface of the closure channel to underlie the rim 12 and provide a first lock between the closure 22 and rim 12 of container 10. A second annular protrusion 36 is formed on the bottom of skirt 24 to coact with the flange 14 to provide a second, stronger lock between the container and closure. In the applied and integral condition, the bottom of the skirt 24 lies closely adjacent the bottom flange 16 and at approximately the same radial distance from the container sidewall. This limits access to the skirt bottom and makes removal of the closure more difficult before the tear band is removed.

The closure 24 is the reentrant type; i.e., it has an annular wall portion 38 which extends into the container interior to provide a flat center section 40 on which the bottom of a second container 10 can rest when stacked on the closure of a lower container.

Referring now to FIGS. 1, 3, 4 and 6, access to the content of container 10 is gained, alter the closure 22 is filly applied, by removal of the tear band; i.e., the strip-like portion of the skirt 24 which lies below the tear line 26. A starter tab 42 is formed by an L-shaped slot molded into the closure 22 as shown in FIG. 1. Removal of the tear-band results in the structure shown in FIG. 4; i.e., the portion 36 defining the bottom lock has been removed. Because the tear line 26 is of a zig-zag design, removal of the tear band results in the definition of three spread tabs 46 which at least partially overlie gaps 44 in the segmented flange 14. The gaps allow the user to grasp and pull the tabs 46 outwardly and upwardly to remove the closure from the container. Because the number of gaps 44 is greater than the number of tabs 46, at least two tabs will overlie gap 44 no matter what the angular orientation of the closure 22 when applied to the container 10.

Figure 5:
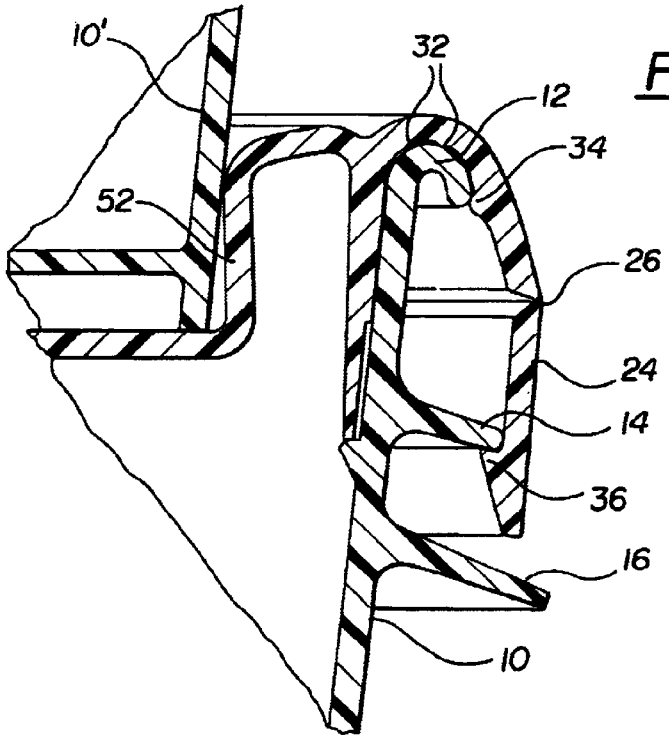
FIG. 5 is a diagrammatic sketch of the container and closure of the present invention when under compression due to stacking of the containers.
Figure 6:
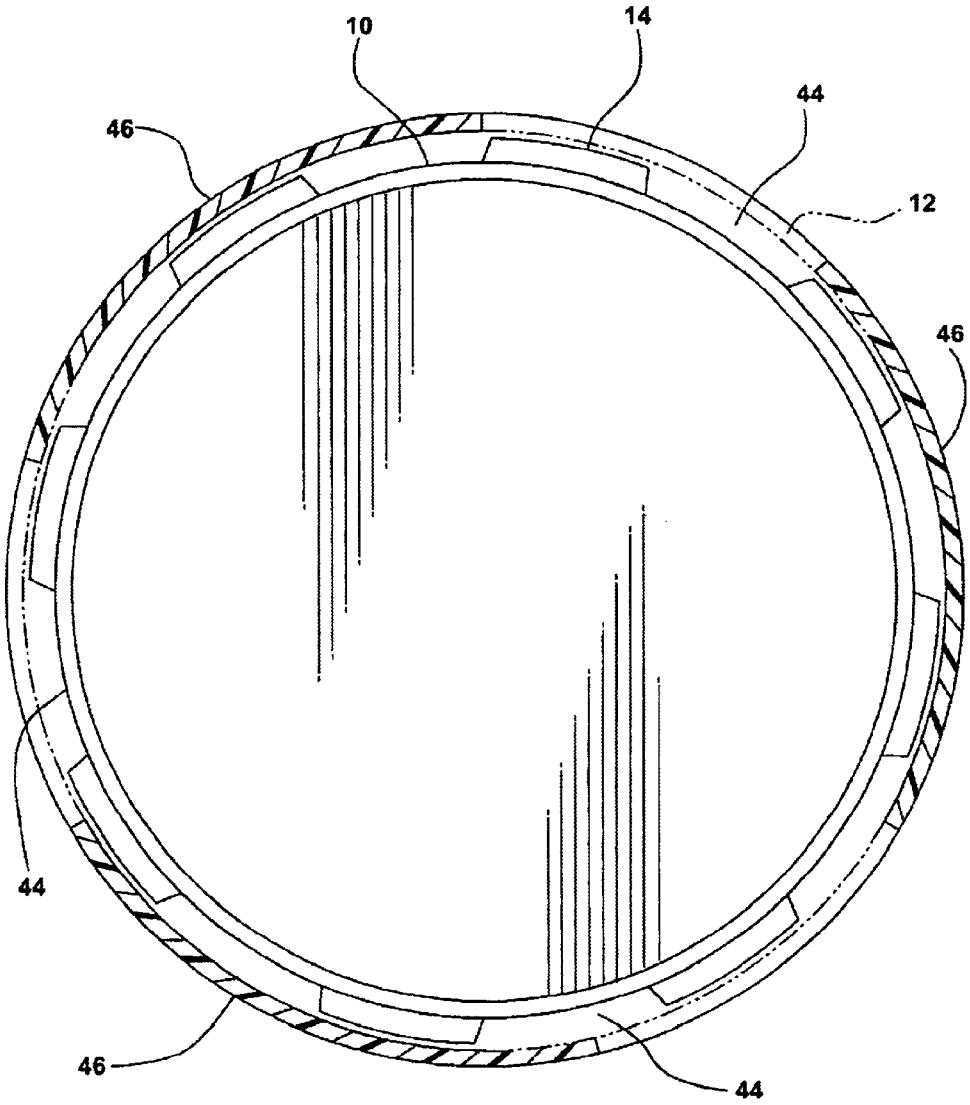
FIG. 6 is a plan view of the closure of the present invention showing a plurality of circumferentially spaced tabs.

Referring now to FIG. 5, when weight is placed on the closure 22, such as when containers are stacked, the force is transmitted down the annular support wall 30 to the step 28 located on the inside of the container wall. The point of contact between the annular support wall 30, and the step 28, remains stationary while other lid features generally flex or rotate about it. The annular support wall 30, being flexible, bends and flexes into the wall of the container 10. Clearance vents 50 are located periodically about the lower portion of the annular support wall 30 to prevent air from being trapped between the closure and pail. The inner leg 52 rotates towards the stacked container 10 until it comes into contact with the lower wall of the stacked container 10. This contact prevents further rotation of the lid 22 flexing around the container rim 12. Circumferential ribs 32 move but remain in contact with the container rim 12, thus maintaining the sealed condition. The lock created by protrusion 34 and rim 12 remains intact. The tear line 26 acts as a hinge, allowing the lower portion of the skirt 24 to bend relative to the upper portion. The locking projection 36 located on the lower portion of the skirt 24 maintains contact with the locking flange 14. The locking flange 14 is deflected upward, thus increasing the contact length with locking projection 36 and enhancing the engagement between the locking flange 14 and the locking projection 36. The protection flange 16 continues to protect the closure 22 from accidental disengagement and to prevent accidental damage to the lower portion of the skirt 34.

Figure 3:
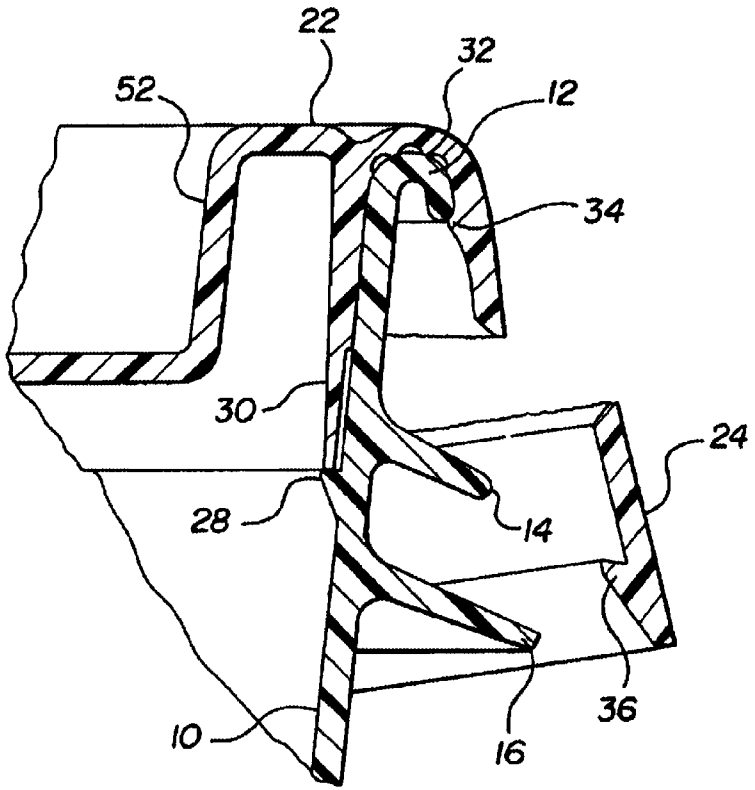
FIG. 3 repeats the FIG. 2 view but with the tear-band partially removed.
Figure 4:
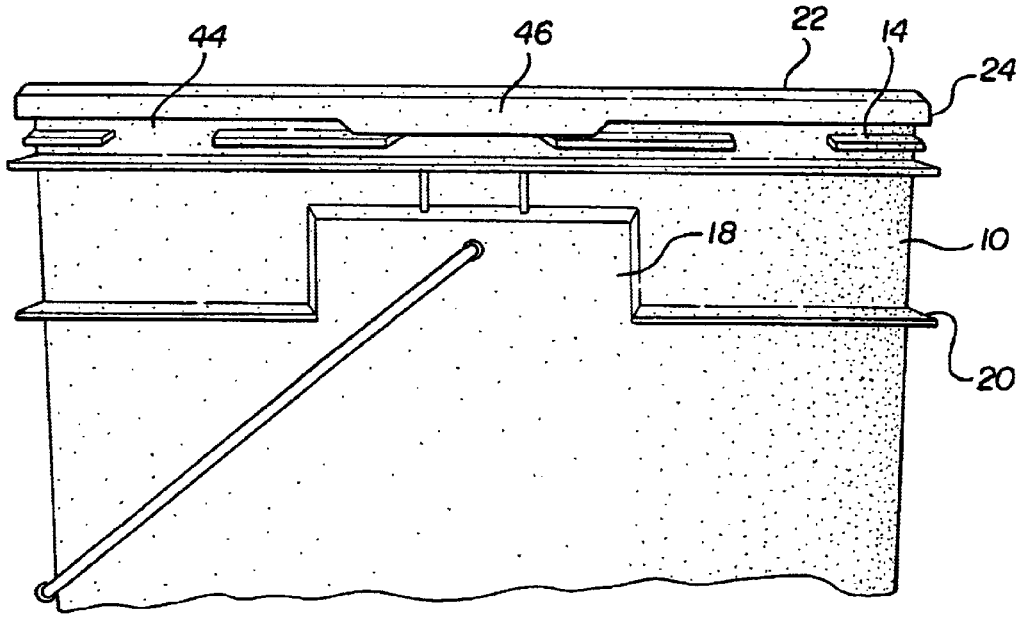
FIG. 4 shows the assembled container and closure combination with the tear-band removed.

After delivery of the sealed and filled container 10 to an end user, the user opens the container 10 by first removing the tear band, as shown in FIGS. 3 and 4. The closure 22 is removed by bending the upper skirt portion 46 away from the container 10 and providing a force in an upward direction. The projection 34, which forms a weaker lock, is pulled over the rim 12 of the container 10, allowing the closure 22 to be disengaged from the container 10. Upon reclosing the container 10, the closure 22 is pressed until the projection 34 lockingly engages with the rim 12 of the container 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A molded plastic container and closure combination comprising:

a container having a substantially cylindrical sidewall and an open top with a peripheral rim; a first segmented circumferential flange on the exterior of said sidewall below said rim having gaps therein; a second continuous, circumferential flange on the exterior of said sidewall below said first flange;

a closure having an inverted U-shaped peripheral channel defined by a radially spaced inner wall and outer skirt respectively; said outer skirt having a first internal locking protrusion which coacts with said rim and a second internal locking protrusion which coacts with said first flange, and a tear line between said first and second internal protrusions;

said tear line being of a zig-zag path to define, when separated, a plurality of circumferentially spaced grasp tabs separated by clearances; at least some of said tabs overlying said gaps in the first flange;

wherein the number of segments in the first flange is different from the number of tabs in said outer skirt after tearing.

2. The combination of claim 1 wherein the container has a step formed on the inner surface of said sidewall to receive said inner closure wall.

3. The combination of claim 2 wherein clearance vents are formed on the inner surface of said inner wall.

4. The combination of claim 1 further comprising seal ridges formed on the inner surface of said inverted U-shaped channel.

5. The combination of claim 1 wherein said closure is reentrant to provide a stacking recess.

6. A molded plastic container and closure combination comprising:

a container having a substantially cylindrical sidewall and an open top with a peripheral rim;

first and second circumferential flanges formed on the exterior of said sidewall at vertically spaced locations below said rim;

a closure having an inverted U-shaped peripheral channel defined by a radial space between an inner wall and an outer skirt; said outer skirt having a first internal locking protrusion which coacts with said rim and a second internal locking protrusion which coacts with said first flange to hold the closure on the container, and a zig-zag tear line lying entirely between said first and second protrusions;

said inner wall extending vertically substantially beyond the tear line;

the uppermost of said first and second circumferential flanges being uniformly interrupted to form gaps therein;

the number of gaps being different from the number of discontinuities in said zig-zag tear line.

7. The combination defined in claim 6 further comprising a step formed on the interior of said container sidewall at a depth to be contacted by said closure inner wall when the closure is placed on the container.

8. The combination defined in claim 7 further comprising at least one clearance vent formed in said inner wall and lying between the inner wall and the interior of the container sidewall when the closure is in place on the container.

9. The combination defined in claim 6 wherein the topmost of the first and second circumferential flanges is segmented.

* * * * *